US007377745B2

(12) United States Patent
Yoshida

(10) Patent No.: US 7,377,745 B2
(45) Date of Patent: May 27, 2008

(54) WATER PUMP

(75) Inventor: Tadafumi Yoshida, Nisshin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/295,559

(22) Filed: Dec. 7, 2005

(65) Prior Publication Data

US 2006/0133932 A1 Jun. 22, 2006

(30) Foreign Application Priority Data

Dec. 22, 2004 (JP) ..... 2004-370334

(51) Int. Cl.
*F01D 25/28* (2006.01)

(52) U.S. Cl. ..... 415/213.1; 415/206

(58) Field of Classification Search ..... 415/213.1, 415/206, 173.1, 216.1, 203
See application file for complete search history.

(56) References Cited

U.S. PATENT DOCUMENTS 2,925,783 A * 2/1960 Zimmermann et al. .. 415/213.1
4,013,383 A 3/1977 Rule
4,308,994 A * 1/1982 Perhats ..... 417/420

FOREIGN PATENT DOCUMENTS

AU 432 760 B2 12/1970
JP U-05-058899 1/1992
JP 07 247958 9/1995
JP 07 247985 9/1995
JP 07247985 A * 9/1995
JP A-11-30191 2/1999

OTHER PUBLICATIONS

English Language Version of European Search Report, Appln. No. 05026000.9, issued Jun. 11, 2007.
Chinese Language Version of Chinese Office Action, Appln. No. 200510132264.3 dated Nov. 9, 2007.
English Translation of Chinese Office Action, Appln. No. 200510132264.3 dated Nov. 9, 2007.
Chinese Language Version of Chinese Office Action, Appln. No. 200510132264.3 dated Nov. 9, 2007.
English Translation of Chinese Office Action, Appln. No. 200510132264.3 dated Nov. 9, 2007.

* cited by examiner

*Primary Examiner*—Igor Kershteyn
(74) *Attorney, Agent, or Firm*—Kenyon & Kenyon LLP

(57) ABSTRACT

A water pump includes an impeller; an impeller shaft around which the impeller rotates; a first bearing portion that supports one end of the impeller shaft; a second bearing portion that supports the other end of the impeller shaft; a housing portion in which the impeller is inserted; and an upper housing including attachment holes provided at equal intervals in a circumferential direction, which are used to attach the upper housing to the housing portion, and a discharge port from which coolant is discharged.

16 Claims, 3 Drawing Sheets

WATER PUMP

INCORPORATION BY REFERENCE

The disclosure of Japanese Patent Application No. 2004-370334 filed on Dec. 22, 2004 including the specification, drawings and abstract is incorporated herein by reference in its entirety.

BACKGROUND OF THE INVENTION

1. Field of the Invention

The invention relates to a water pump for circulating coolant or the like.

2. Description of the Related Art

For example, in a vehicle using a motor as a power source, a water pump is used for circulating coolant that cools the motor, an inverter, and the like. In the water pump, a rotatable impeller is provided. When the impeller is rotated, the coolant is discharged from a discharge port so that the coolant is circulated.

Water pumps in which an impeller is housed in a chamber composed of an upper housing and a housing portion in a pump body are known. Also, Japanese Utility Model Application Publication No. 5-58899 discloses a supercharger in which a compressor impeller is housed in a chamber composed of a compressor housing and a bearing chamber body. Further, Japanese Patent Application Publication No. JP 11-30191 A discloses a self-primed centrifugal pump in which an impeller is housed in a chamber composed of an impeller casing and an end casing.

In the aforementioned water pump, a discharge port is provided in the upper housing. The direction in which the discharge port faces with respect to the pump body is set by attaching the upper housing to the pump body.

Meanwhile, in the case where one type of water pump is shared across different vehicle models, because the arrangement of vehicle components varies between vehicle models, it is desirable to have a water pump in which the discharge port can be oriented in a direction as dictated by the layout of the components in a particular vehicle model. Therefore, preferably, the upper housing can be placed in various positions by turning the upper housing by various angles when the upper housing is attached to the pump body.

Also, in order for the water pump to operate quietly, it is desired to reduce operating noise of the water pump, particularly operating noise caused by rotation of the impeller.

SUMMARY OF THE INVENTION

An aspect of the invention relates to a water pump including an impeller; an impeller shaft; a first bearing portion; a second bearing portion; a housing portion; and an upper housing. The impeller rotates around the impeller shaft. The first bearing portion supports one end of the impeller shaft. The second bearing portion supports the other end of the impeller shaft. The impeller is inserted in the housing portion. The upper housing includes attachment holes provided at equal intervals in a circumferential direction, which are used to attach the upper housing to the housing portion; and a discharge port from which coolant is discharged.

Another aspect of the invention relates to a water pump including an impeller; an impeller shaft; a first bearing portion; a second bearing portion; a housing portion; and an upper housing. The impeller rotates around the impeller shaft. The housing portion includes the second bearing portion which supports one end of the impeller shaft, and the impeller is inserted in the housing portion. The upper housing includes attachment holes provided at equal intervals in the circumferential direction, which are used to attach the upper housing to the housing portion; the first bearing portion which supports the other end of the impeller shaft; and a discharge port from which coolant is discharged. In the water pump, when the upper housing is attached to the housing portion using the attachment holes, the upper housing is placed in a desired attachment position that is selected from a plurality of attachment positions by turning the upper housing in the circumferential direction by a predetermined angle such that the discharge port faces a desired direction.

According to the aforementioned aspects of the invention, because both ends of the impeller shaft are supported, for example, vibration noise caused by rotation of the impeller shaft can be reduced, as compared to the case where only one end of the impeller shaft is supported.

Further, according to the aforementioned aspects of the invention, the discharge port can be oriented to face a desired direction.

BRIEF DESCRIPTION OF THE DRAWINGS

The foregoing and further objects, features and advantages of the invention will become apparent from the following description of an exemplary embodiment with reference to the accompanying drawings, wherein like numerals are used to represent like elements and wherein.

DETAILED DESCRIPTION OF THE EXEMPLARY EMBODIMENTS

Hereinafter, an exemplary embodiment will be described with reference to the drawings.

Figure 1:
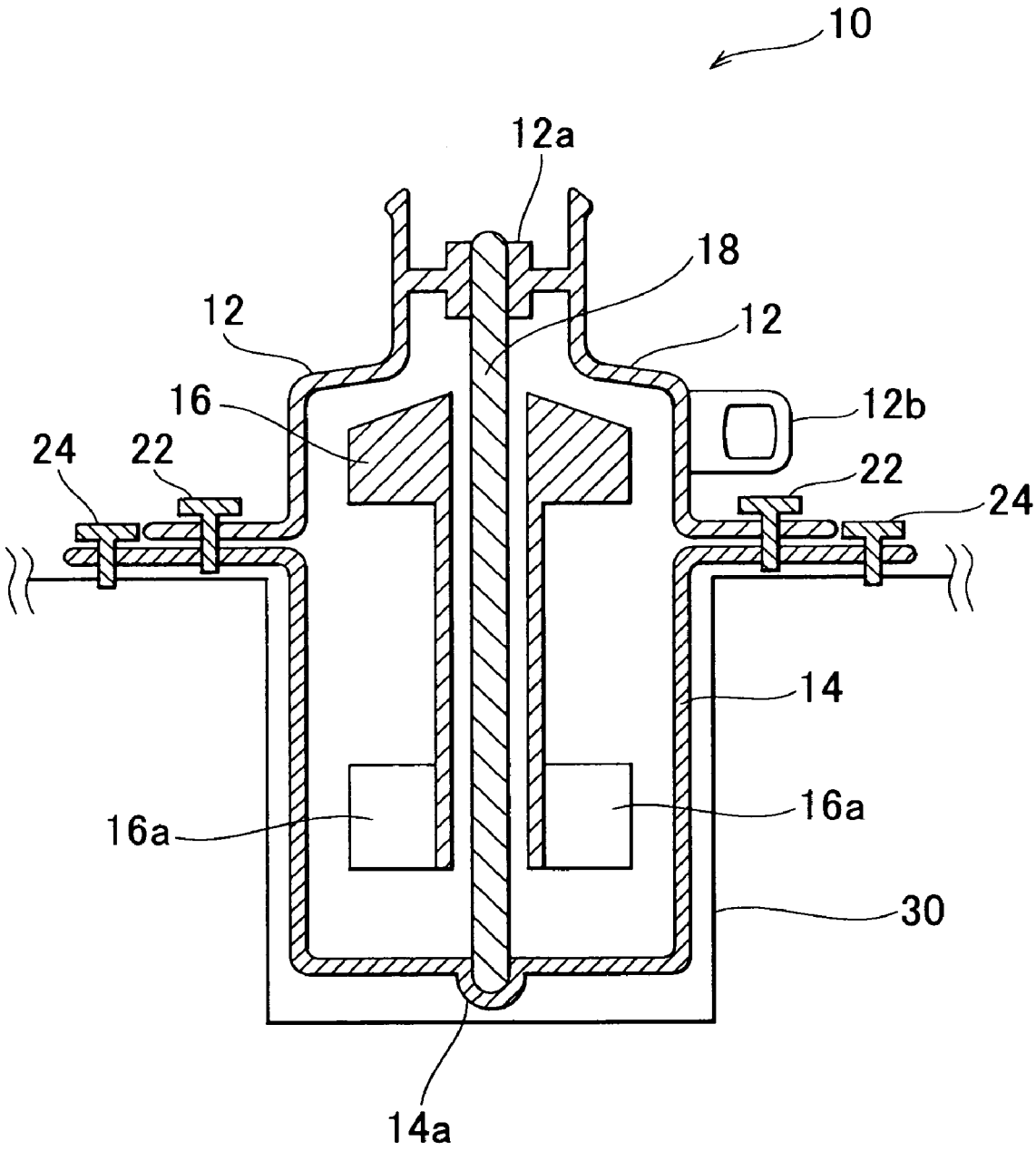
FIG. 1 is a sectional view showing an entire configuration of an embodiment of a water pump according to the invention.

FIG. 1 shows a sectional view showing an entire configuration of an embodiment of a water pump according to the invention.

In a water pump 10 according to the embodiment of the invention, an impeller 16 is housed in an impeller housing portion, composed of an upper housing 12 and a pump body housing 14. The pump body housing 14 is provided inside a pump body 30, and is attached to the pump body 30. The impeller housing portion composed of the upper housing 12 and the pump body housing 14 has a substantially cylindrical shape. An impeller shaft 18 is disposed on the central axis of the impeller housing portion. FIG. 1 is a sectional view of the water pump 10 taken along a plane including the impeller shaft 18.

The upper housing 12 includes a first bearing portion 12*a*, and a discharge port 12*b*. The first bearing portion supports one end of the impeller shaft 18. Coolant is discharged from the discharge port 12*b*. The upper housing 12 is attached to the pump body housing 14 using a plurality of bolts 22. The plurality of bolts 22 are disposed at equal intervals in a circumferential direction.

The pump body housing 14 includes a second bearing portion 14*a* that supports the other end of the impeller shaft 18. The pump body housing 14 is attached to the pump body 30 using a plurality of bolts 24.

The impeller 16 is housed so as to be rotatable in the impeller housing portion composed of the upper housing 12 and the pump body housing 14. The impeller 16 is formed to have a hollow shape. The impeller shaft 18 passes through the center portion of the impeller 16. The impeller 16 includes a plurality of permanent magnets 16*a*. When the permanent magnets 16*a* receive rotational driving force from a drive coil (not shown) provided in the pump body 30, the impeller 16 rotates about the impeller shaft 18 that serves as a central axis.

In this embodiment, the two ends of the impeller shaft 18 are supported by the first bearing portion 12*a* and the second bearing portion 14*a*. Therefore, when the impeller 16 rotates, noise caused by rotation of the impeller 16 can be reduced, as compared to the case where only one end of the impeller shaft 18 is supported. For example, in this embodiment, by supporting both ends of the impeller shaft 18 vibration of the impeller shaft 18 caused by the rotation of the impeller 16 can be suppressed, which reduces operating noise caused by the vibration of the impeller shaft 18, as compared to the case where only one end of the impeller shaft 18 is supported.

In this embodiment, the ends of the impeller shaft 18 are fixed to the first bearing portion 12*a* and the second bearing portion 14*a*, and the impeller 16 rotates around the fixed impeller shaft 18. That is, the impeller shaft 18 does not rotate. However, in alternative embodiments, the impeller shaft 18 may be fixed to the impeller 16, and the impeller shaft 18, supported by the first bearing portion 12*a* and the second bearing portion 14*a*, may rotate freely.

Also, in this embodiment, the pump body housing 14 may be omitted, and the upper housing 12 may be directly attached to the pump body 30. In this case, the pump body 30 includes a bearing portion equivalent to the second bearing portion 14*a*.

Figure 2:
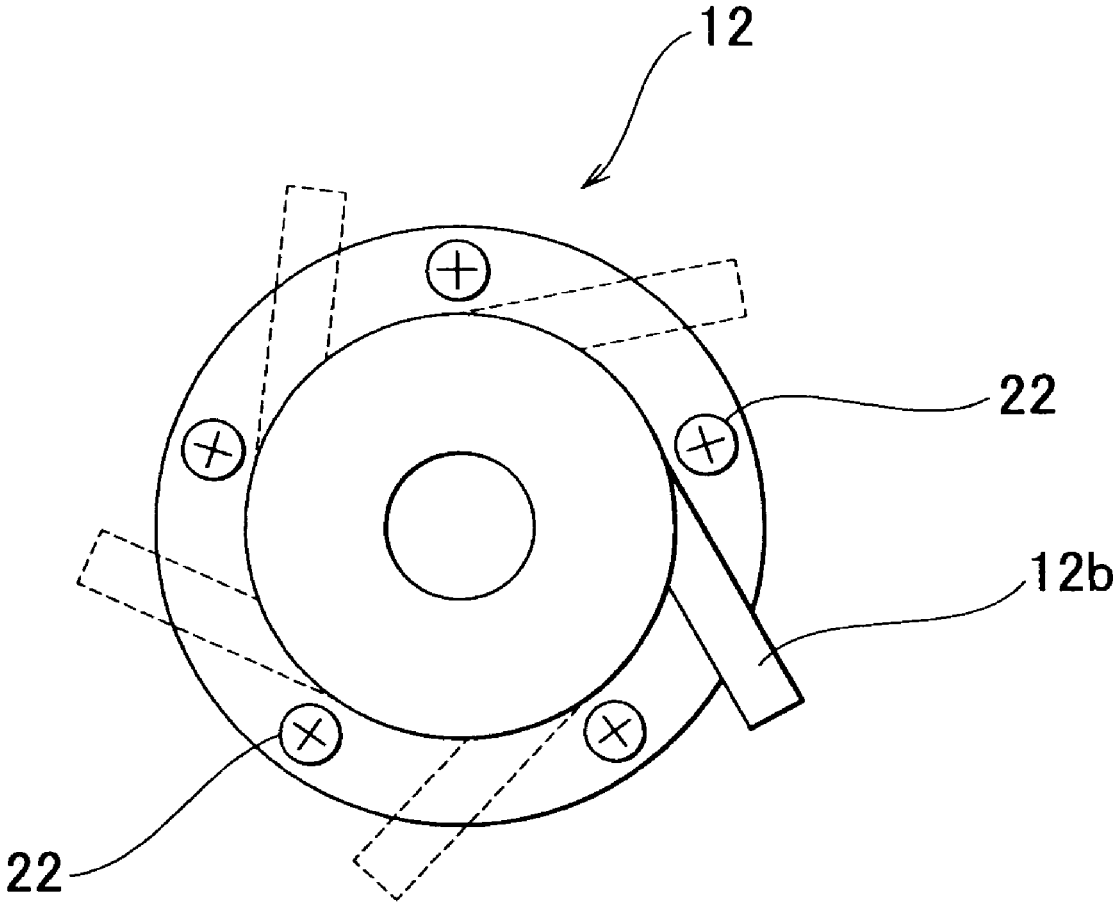
FIG. 2 is a diagram showing an embodiment in which an upper housing is attached to a pump body housing in the water pump according to the invention.

FIG. 2 shows an example embodiment in which the upper housing 12 is attached to the pump body housing 14 in the water pump 10 according to the invention. FIG. 2 is a planar view of the upper housing 12 shown in FIG. 1.

The upper housing 12 includes a discharge port 12*b* from which the coolant is discharged. A plurality of bolts 22, in this embodiment five bolts 22 are used, are inserted in bolt insertion portions provided at equal intervals in a circumferential direction. The upper housing 12 is attached to the pump body housing using the plurality of bolts 22.

In this embodiment, when the upper housing 12 is attached to the pump body housing 14, the upper housing 12 can be placed in any one of attachment positions by turning the upper housing 12 with respect to the pump body 30 in the circumferential direction. At each attachment position, the discharge port 12*b* faces a different direction. Since the five bolts 22 are disposed at equal intervals (i.e., at intervals of 72 degrees) in the circumferential direction in FIG. 2, the upper housing 12 can be placed in any one of five attachment positions by turning the upper housing 12 in the circumferential direction by a predetermined angle that is a multiple of 72 degrees from a predetermined starting point. Therefore, the discharge port 12*b* can be placed in any one of five positions indicated by a solid line and dash lines. Thus, the discharge port 12*b* can face in a desired direction.

The upper housing 12 may be attached to the pump body housing 14 using a vibration welding method. In the case where the upper housing 12 is attached to the pump body housing by a vibration welding method, it is difficult to accurately place the upper housing 12 in a predetermined position. However, in this embodiment, the upper housing 12 can be accurately fixed in a predetermined position using five bolts 22, as shown.

FIG. 2 shows the case where five bolts 22 are used. However, the number of bolts 22 may be changed by changing the number of bolt insertion portions provided in the upper housing 12. If the number of bolts 22 is increased, for example, to six or more, the upper housing 12 can be placed in a greater number of orientations for attachment positions, and thus the discharge port 12*b* can be oriented in more directions.

Figure 3A:
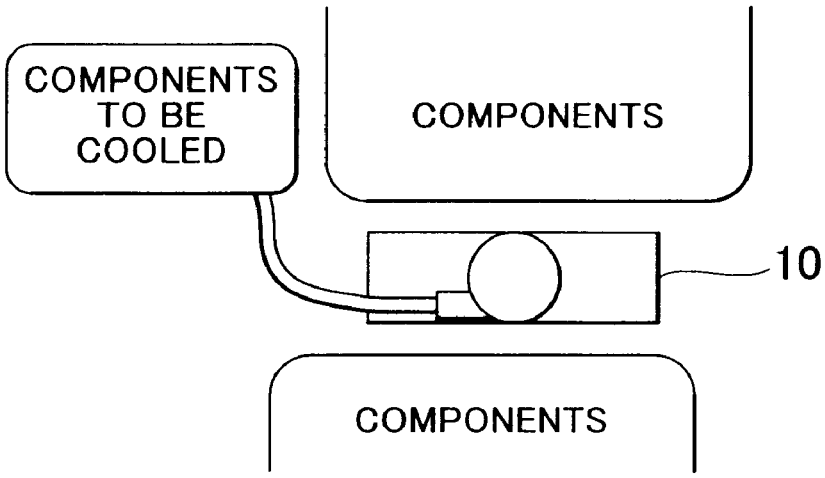
FIGS. 3A and 3B are diagrams showing examples in each of which the water pump according to the embodiment of the invention is used.
Figure 3B:
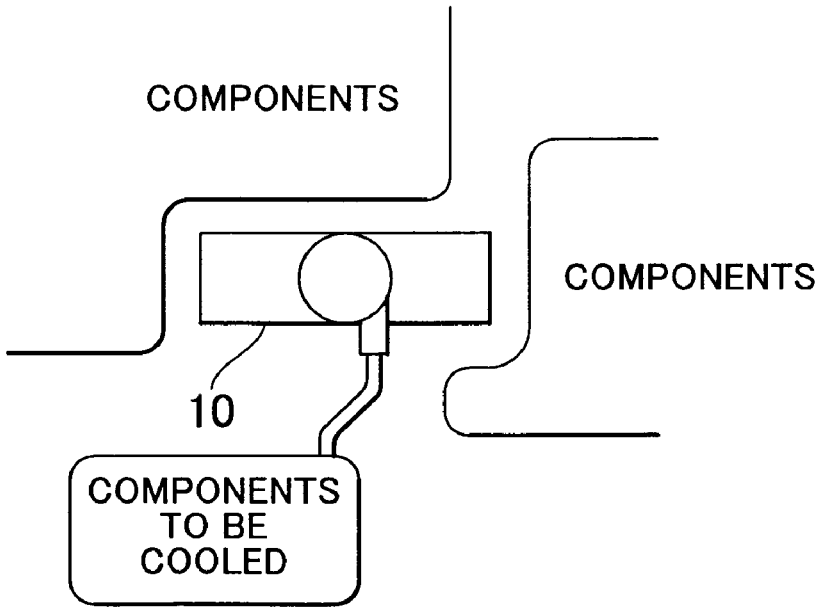

Each of FIG. 3A and FIG. 3B shows an example in which the water pump 10 according to this embodiment is used. In each of FIG. 3A and FIG. 3B, the water pump 10 according to this embodiment is installed in a different vehicle model.

For example, the water pump 10 is used to circulate coolant that cools a motor, an inverter, and the like. The water pump 10 is provided at a give location in a coolant circulation passage that connects the inverter, the motor, and a radiator (for example, at a location between the inverter and the motor). The water pump 10 discharges the coolant that has been cooled by the radiator.

However, since a large number of components are installed in a vehicle, the range of locations where the water pump 10 can be installed, the range of directions in which the water pump 10 can face, and the like are limited by the arrangement of the other components. Particularly, the location where the water pump 10 is installed and the direction in which the water pump 10 faces may greatly vary among vehicle models. In the water pump 10 according to the embodiment, the discharge port 12*b* can be oriented to face various directions. Therefore, the water pump 10 is advantageous in the case where the water pump 10 is installed in different vehicle models.

For example, in a vehicle model with components arranged as shown in FIG. 3A, the discharge port of the water pump 10 faces to the left so that coolant can be supplied from the discharge port to components to be cooled. In a different vehicle model with components arranged as shown in FIG. 3B, the discharge port of the water pump 10 faces downward so that coolant can be supplied from the discharge port to components to be cooled. Thus, the discharge port can be oriented to face a desired direction appropriate for the vehicle model in which the water pump 10 is installed.

While the invention has been described with reference to the exemplary embodiment thereof, it should be understood that the invention is not limited to the exemplary embodiment or construction. To the contrary, the invention is intended to cover various modifications and equivalent arrangements. In addition, while the various elements of the exemplary embodiment are shown in various combinations and configurations, which are exemplary, other combinations and configurations, including more, less or only a single element, are also within the spirit and scope of the invention.

What is claimed is:

1. A water pump assembly, comprising:

an impeller;

an impeller shaft around which the impeller rotates;

a first bearing portion that supports one end of the impeller shaft;

a second bearing portion that supports the other end of the impeller shaft;

a housing portion having a central axis along which the impeller is inserted;

an upper housing having a flange including attachment holes provided at equal intervals in a circumferential direction, which are used to attach the upper housing to the housing portion, and a discharge port from which coolant is discharged;

a water pump that is used for circulating coolant in a vehicle using a motor as a power source;

a first plurality of bolts for attaching the upper housing to the housing portion; and a second plurality of bolts for attaching the upper housing to the water pump, wherein a distance between the central axis and the second plurality of bolts is greater than a distance between the central axis and the first plurality of bolts, as well as, a distance between the central axis and an end of the flange.

2. The water pump assembly according to claim 1, wherein the housing portion is integrated into a water pump body.

3. The water pump assembly according to claim 1, wherein the first bearing portion is provided in one of the upper housing and the housing portion, and the second bearing portion is provided in the other of the upper housing and the housing portion.

4. The water pump assembly according to claim 1, wherein the impeller shaft is fixed to the first bearing portion and the second bearing portion; and the impeller is rotatable around the impeller shaft.

5. The water pump assembly according to claim 1, wherein the impeller shaft is fixed to the impeller; and the impeller shaft, supported by the first bearing portion and the second bearing portion, is rotatable.

6. The water pump assembly according to claim 1, wherein the discharge port faces a direction appropriate for a vehicle model in which the water pump is installed.

7. The water pump assembly according to claim 1, wherein the discharge port is configured to face one of five different directions.

8. The water pump assembly according to claim 1, wherein the discharge port moves circumferentially in predetermined intervals which are multiples of 72° from a predetermined starting position.

9. The water pump assembly according to claim 1, wherein five attachment holes are provided so that the discharge port is moveable circumferentially in five 72° intervals.

10. The water pump assembly according to claim 1, wherein the water pump is located in a coolant circulation passage that connects at least an inverter, the motor, and a radiator.

11. A water pump assembly, comprising:

an impeller;

an impeller shaft that serves as an axis of rotation of the impeller;

a first bearing portion and a second bearing portion;

a housing portion having a central axis and which includes the second bearing portion that supports one end of the impeller shaft, and in which the impeller is inserted;

an upper housing having a flange including attachment holes provided at equal intervals in a circumferential direction, which are used to attach the upper housing to the housing portion; the first bearing portion which supports the other end of the impeller shaft; and a discharge port from which coolant is discharged, wherein when the upper housing is attached to the housing portion using the attachment holes, the upper housing is placed in a desired attachment position that is selected from a plurality of attachment positions by turning the upper housing in the circumferential direction by a predetermined angle such that the discharge port faces a desired direction;

a water pump that is used for circulating coolant in a vehicle using a motor as a power source;

a first plurality of bolts for attaching the upper housing to the housing portion; and a second plurality of bolts for attaching the upper housing to the water pump, wherein a distance between the central axis and the second plurality of bolts is greater than a distance between the central axis and the first plurality of bolts, as well as, a distance between the central axis and an end of the flange.

12. The water pump assembly according to claim 11, wherein the discharge port faces a direction appropriate for a vehicle model in which the water pump is installed.

13. The water pump assembly according to claim 11, wherein the discharge port is configured to face one of five different directions.

14. The water pump assembly according to claim 11, wherein the discharge port moves circumferentially in predetermined intervals which are multiples of 72° from a predetermined starting position.

15. The water pump assembly according to claim 11, wherein five attachment holes are provided so that the discharge port is moveable circumferentially in five 72° intervals.

16. The water pump assembly according to claim 11, wherein the water pump is located in a coolant circulation passage that connects at least inverter, the motor, and a radiator.

* * * * *

UNITED STATES PATENT AND TRADEMARK OFFICE

CERTIFICATE OF CORRECTION

PATENT NO. : 7,377,745 B2
APPLICATION NO. : 11/295559
DATED : May 27, 2008
INVENTOR(S) : Tadafumi Yoshida It is certified that error appears in the above-identified patent and that said Letters Patent is hereby corrected as shown below:

| Column | Line | |
|---|---|---|
| 6 | 49 | After “at least” insert --an--. |

Signed and Sealed this

Ninth Day of June, 2009

JOHN DOLL
*Acting Director of the United States Patent and Trademark Office*